United States Patent [19]

Taylor

[11] 4,131,281

[45] Dec. 26, 1978

[54] GAME BOARD APPARATUS

[76] Inventor: Samson R. Taylor, 54 Bower St., Boston, Mass. 02119

[21] Appl. No.: 853,455

[22] Filed: Nov. 21, 1977

[51] Int. Cl.[2] ..... A63F 3/00

[52] U.S. Cl. ..... 273/248; 273/282

[58] Field of Search ..... 273/248, 249, 258, 282

[56] References Cited

U.S. PATENT DOCUMENTS

| | | | |
|---|---|---|---|
| 2,187,808 | 1/1940 | Parker | 273/258 |
| 2,750,193 | 6/1956 | Wales | 273/258 X |
| 3,116,928 | 1/1964 | Wilde, Sr. | 273/282 |
| 3,356,369 | 12/1967 | Stubbmann | 273/248 X |
| 3,514,110 | 5/1970 | Thomander | 273/282 X |
| 3,843,131 | 10/1974 | Stubbmann | 273/248 |

*Primary Examiner*—William H. Grieb
*Assistant Examiner*—Harry G. Strappello
*Attorney, Agent, or Firm*—William Nitkin

[57] ABSTRACT

A game board apparatus having an octagonal game board with four game zones defined thereon, having therein a storage zone, a starting zone and a playing zone, each of said zones having a plurality of marker receptacles integrally part of said game board and a centrally located die-agitating device.

3 Claims, 2 Drawing Figures

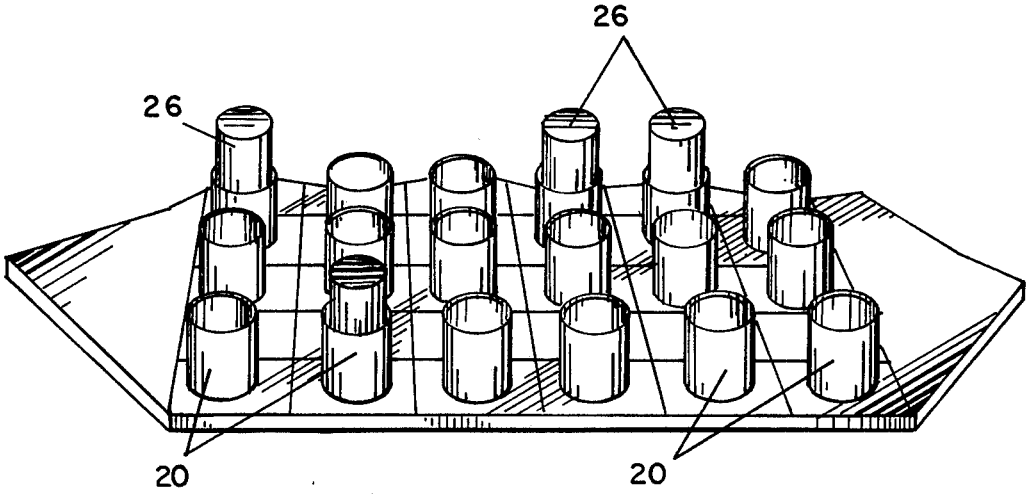
FIG. 2
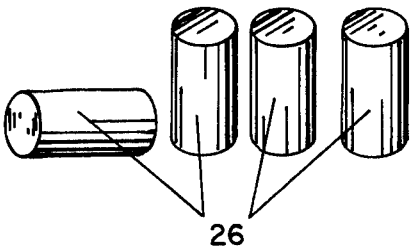

GAME BOARD APPARATUS

BACKGROUND OF THE INVENTION

The present invention relates generally to games of amusement and more particulary to games utilizing game boards, movable markers, and centrally located die-agitating devices.

There are many games utilizing game boards currently in existance. Some like the present invention utilize a centrally located die agitating device. Such games are exemplified by Board Game Apparatus by Stubbmann 3,843,131 or by Die Agitating Chance Device also by Stubbmann 3,356,369. There are also a wide variety of board games utilizing markers movable in various positions across the game board such as exemplified by Game by G. S. Parker 2,187,808 and by the game of Chinese checkers utilizing marbles on a board having depressions holding the marbles which are moved to different positions across the board according to the rules of the game.

SUMMARY

The present invention discloses a novel game board utilizing a centrally located die-agitating device in order to determine numbers by chance which are utilized by players of the game. The game of the present invention may be played by two, three, or four player zones, each such zone subdivided into three game zones being a storage zone, a starting zone and a playing zone. Central to the board is a die-agitating device which can be of the types desribed in the aforementioned patents of the prior art or any similar die-agitating device which can be operated by any of the players. The numbers on the die are 1, 2, 3, 4, and 5 with one side of the die being blank. The shape of the game board has portions referred to as board zones which allow players to rest objects such as refreshments on the game board without such objects getting in the way of the actual playing. These board zones add to the enjoyment of the game. The game utilizes a plurality of marker pieces which can be small pegs or any other marker device or equivalent. These markers are initially placed individually in a plurality of receptacle cups within the storage zones of the game board. When it is a player's turn, that player selects a marker from the storage zone and moves it to any receptacle cup within the starting zone. Upon agitation of the centrally located die-agitating device, the player whose turn it is reads the number on the die and moves a marker piece from the starting zone into the playing zone the number of spaces indicated on the die. The object of the game is to move all of one's marker pieces from the storage zone into the playing zone. Each player has his own storage, starting, and playing zones and manipulates his own marker pieces within these zones. His markers do not cross into any game zones of other players thereby allowing each player to concentrate his attention on his own marker pieces without having to be concerned about the positioning of the marker pieces of other players except to note the speed at which his opponents are placing their marker pieces into their playing zones. In the preferred embodiment of the present invention there are thirty marker pieces per player. The arrangement of receptacle cups which hold these markers in each player's storage and playing zones is an arrangement of six columns across and five rows deep of receptacle cups which can be integrally constructed as part of the game board. The starting zone consists of a row of six receptacle cups and is interposed between the thirty receptacle cups of the storage zone and the thirty receptacle cups of the playing zone, the receptacle cups forming six columns in line. As the game progresses the player whose turn it is takes marker piece from any receptacle cup in his storage zone and moves it to any receptacle cup in the starting zone he may select. That player then agitates the die-agitating device and advances that marker piece forward that number appearing on the die into a receptacle cup in the playing zone. If the receptacle cup in the playing zone to which the player would advance the marker piece already has a marker piece in it, the first marker piece will remain in the starting zone and the next player will take his turn. A player may move a marker piece from any column in the storage zone to any column in the starting zone depending upon his strategy in filling the receptacle cups of the playing zone. If the blank side of the die should come up, that player may miss a turn or may take another turn depending upon the rules of the game agreed upon by the players. The game continues until one player has moved all his marker pieces into his playing zone.

The objects of this game will become clearer with reference to the following diagrams and Description of the Preferred Embodiment.

BRIEF DESCRIPTION OF THE DRAWINGS

FIG. 2 illustrates an enlarged sectional perspective view of the board and a plurality of marker pieces positioned within receptacle cups.

DESCRIPTION OF THE PREFERRED EMBODIMENT

Figure 1:
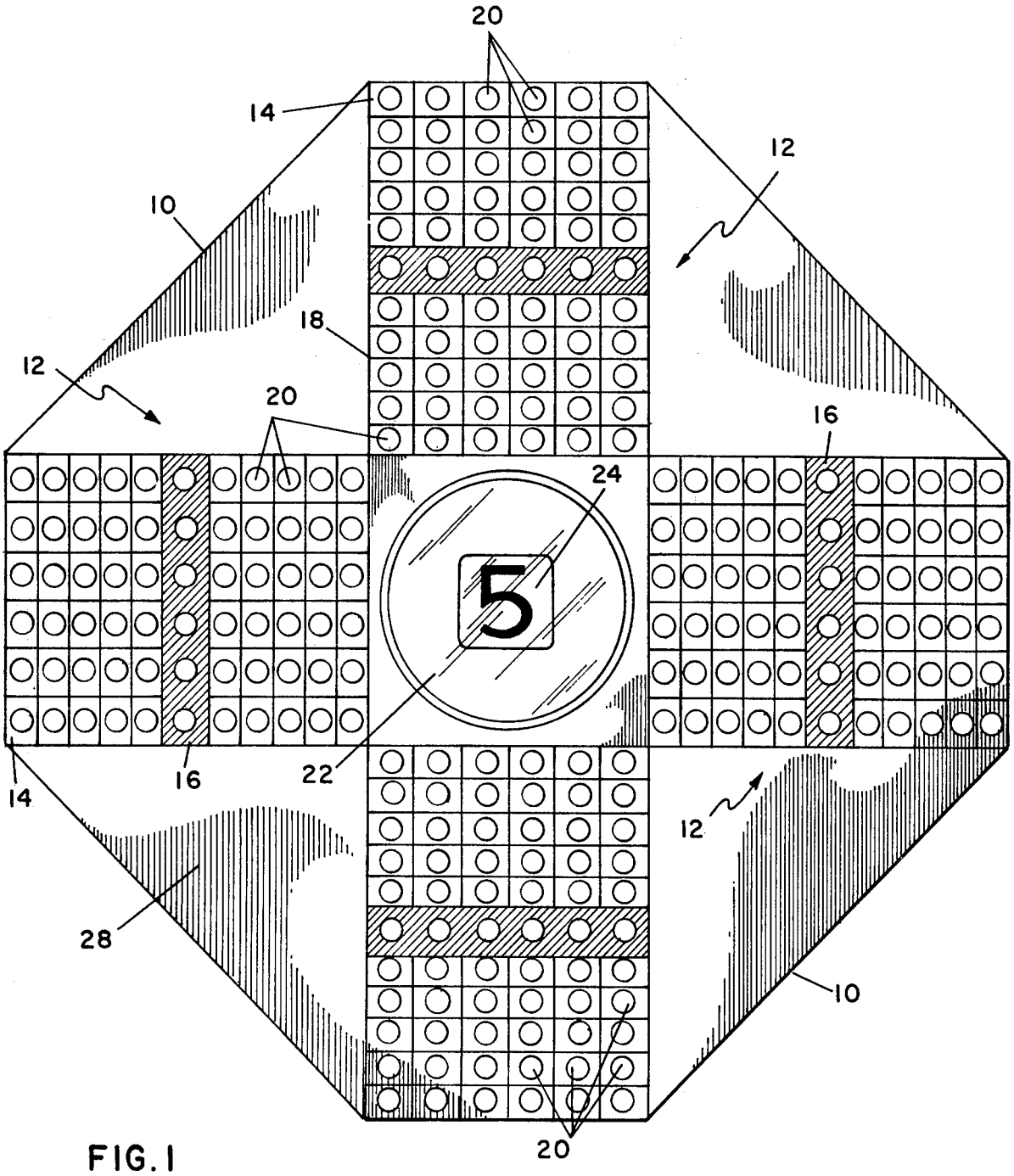
FIG. 1 is a top view of the game board showing the receptacle cups of the four game zones arrayed around the centrally located die-agitating device.

FIG. 1 illustrates a view of the game board 10 of this invention which in its preferred embodiment is octagonal in shape and has four player zones 12, one of which is utilized by each of the players playing the game. Central to the board is the die-agitating device 22 with a die 24 located therein. Each game zone is made up of three zones: the storage zone 14, the starting zone 16, and the playing zone 18. Each of these zones has within it a plurality of receptacle cups 20. The storage zone and the playing zone each have thirty receptacle cups 20 arranged in six columns across and five rows deep. The starting zone interposed between the storage and playing zones has a series of six receptacle cups which can be distinguished by the initial "S" or other means of differentiation such as by color or equivalent means from the receptacle cups of the playing zone or of the storage zone. Between the game zones 12 for each player are sections of the game board designated board zones 28 for the placement of objects for the players such as refreshments, score cards, or other items which a player may wish to have nearby and which do not get in the way of the other players during the progress of the game. These board zones serve to make the board more convenient to use by the players. In the preferred embodiment each player has thirty marker pieces 26 such as shown in FIG. 2. These marker pieces are initially placed individually in all of the receptacle cups of the storage zone, each receptacle cup can be a small cup-like member permanently affixed to a flat board member or integrally a part thereof. Other equivalent means of maintaining the position of each marker piece can be employed. When it is a player's turn, he advances whichever marker piece he wishes to any one of the starting zone's receptacle cups 16 he selects. He then agitates the die and moves the marker piece he selected forward form the starting zone the number of spaces indicated on the die into a receptacle cup of the playing zone. The die is numbered from 1–5 with one side blank. Whatever number the die shows, the player must move the marker piece forward that number of spaces. However, if there is already a marker piece in place in the receptacle cup spot into the position the player is about to move his marker piece, the player loses his turn and play advances to the next player. Therefore strategy must be employed in determining which marker piece is to be moved into a particular starting zone position, that is, into which column the marker piece will be moved. If significant numbers of receptacle cups of the playing zone are filled in a particular column, then the player might consider advancing a marker piece to the starting position of a playing zone column that is less full in order to increase his chances of advancing that marker piece for the starting zone into the playing zone. The first player to move all his marker pieces from the storage zone through their starting positions and into the playing zone is the winner of the game.

Although the present invention has been described with reference to particular embodiments, it will be apparent to those skilled in the art that variations and modifications can be substituted therefor without departing from the principles and spirit of the invention.

I claim:

1. A game apparatus comprising:

an eight-sided game board having defined thereon four game zones, each of said game zones located adjacent to alternate sides of said game board, each of said game zones including a storage zone, a starting zone, and a playing zone, said storage zone having defined therein a plurality of marker receptacles positioned in six parallel columns positioned perpendicular to the side of said game board adjacent to the storage zone and five rows perpendicular to said columns, said starting zone having defined therein six marker receptacles each located at the end of one of said storage zone columns of marker receptacles, said playing zone having defined therein a plurality of marker receptacles arranged in an array of six columns and five rows, said six playing zone marker receptacle columns each being in line respectively with said six storage zone marker receptacle columns, said game board further having defined therein four board zones, each board zone located between said game zones, said game board yet further having a centrally located die-agitating device with one die therein having imprinted on five sides thereof a different number from one to five with one side of the die being blank;

a plurality of marker pieces for placement within said marker receptacles by each player of the game; and said starting zone further having means for distinguishing same from said playing and storage zones.

2. The game apparatus of claim 1 wherein said means for distinguishing the starting zone from said storage and playing zones is color labeling.

3. The game apparatus of claim 1 wherein said marker receptacles comprise receptacle cups which are an integral part of said game board.

* * * * *